United States Patent [19]

Horodysky

[11] Patent Number: 4,808,196

[45] Date of Patent: Feb. 28, 1989

[54] FUELS CONTAINING N-ALKYLALKYLENEDIAMINE AMIDES

[75] Inventor: Andrew G. Horodysky, Cherry Hill, N.J.

[73] Assignee: Mobil Oil Corporation, New York, N.Y.

[21] Appl. No.: 201,241

[22] Filed: Jun. 2, 1988

Related U.S. Application Data

[60] Division of Ser. No. 33,985, Apr. 2, 1987, which is a continuation-in-part of Ser. No. 827,228, Feb. 5, 1986, abandoned, which is a continuation of Ser. No. 705,403, Feb. 25, 1985, abandoned, which is a continuation of Ser. No. 493,463, May 11, 1983, abandoned.

[51] Int. Cl.[4] ..... C10L 1/22

[52] U.S. Cl. ..... 44/71; 252/401; 44/53; 44/56

[58] Field of Search ..... 44/53, 56, 71; 252/401

[56] References Cited

U.S. PATENT DOCUMENTS

| | | | |
|---|---|---|---|
| 2,736,658 | 2/1956 | Pfehl et al. | 106/14 |
| 3,778,372 | 12/1973 | Murphy | 252/51.5 A |
| 4,552,569 | 11/1985 | Horodysky | 44/71 |
| 4,556,497 | 12/1985 | Horodysky et al. | 252/51.5 A |
| 4,581,039 | 4/1986 | Horodysky | 44/71 |
| 4,643,738 | 2/1987 | Sung et al. | 44/71 |
| 4,732,576 | 3/1988 | Friedrich et al. | 44/71 |
| 4,743,273 | 5/1988 | Crowdace et al. | 44/71 |

*Primary Examiner*—Jacqueline V. Howard
*Attorney, Agent, or Firm*—Alexander J. McKillop; Charles J. Speciale; Van D. Harrison, Jr.

[57] ABSTRACT

The invention provides certain N-alkylalkylenediamine amides and their use as friction reducing additives in lubricants. They are also antioxidants and are useful in applications where additive are not corrosive to copper.

15 Claims, No Drawings

FUELS CONTAINING N-ALKYLALKYLENEDIAMINE AMIDES

RELATED APPLICATIONS

This is a division of copending application Ser. No. 033,985, filed on Apr. 2, 1987, which is a continuation in part of application Ser. No. 827,228, filed Feb. 5, 1986, now abandoned, which is a continuation of application of Ser. No. 705,403, filed Feb. 25, 1985, now abandoned, which is a continuation of application of application Ser. No. 493,463, filed May 11, 1983, now abandoned.

BACKGROUND OF THE INVENTION

1. Field of the Invention

The invention relates to lubricant compositions. More particularly, it relates to a group of N-alkylalkylenediamine amides and to their use in lubricants as multipurpose additives. The invention is especially concerned with internal combustion engines.

2. Discussion of Related Art

As those skilled in this art know, additives impart special properties to lubricants. They may give the lubricants new properties or they may enhance properties already present. One property all lubricants have in common is the reduction of friction between materials in contact. Nonetheless, the art constantly seeks new materials to enhance the friction properties of the lubricant.

A lubricant, even without additives, when used in an internal combustion engine, for example, will not only reduce friction, but in the process will also reduce consumption of the fuel required to run it. When oils appeared to be inexhaustable, and cheap, some attention was given to increasing frictional properties, but most of the advances in this area came as a result of additives being placed in lubricants for other purposes. Recent events, however, have spurred research programs designed specificallly to find materials capable of reducing friction.

The use of amides in lubricants is known (see U.S. Pat. No. 3,884,822, for example, which discloses lubricants containing the product of reaction between an amino pyridine an oleic acid), no art teaches or suggests that the amides of this invention are useful for the purposes disclosed herein.

U.S. Pat. No. 3,778,372 discloses that compositions prepared by contacting and reacting formic acid or a formic acid producing compound with alkylene polyamines of specific structural formulas are useful as rust inhibitors. These compositions are not disclosed to be effective as lubricity enhancers in lubricants.

It has now been determined that reaction products of diamines of a certain structural formula with carboxylic acids such a formic acid provide improved lubricity when added to lube oils.

SUMMARY OF THE INVENTION

In accordance with the invention, there is provided a lubricant composition comprising a major proportion of a lubricant and a friction reducing or an antioxidant amount of an N-alkylalkylenediamine amide of the formula $$R^2-\overset{\overset{\displaystyle R^3}{|}}{N}-R^1-NH-R^3$$

wherein $R^1$ is a $C_2$ to $C_4$ alkylene group or mixtures thereof, $R^2$ must be a $C_{12}$ to $C_{30}$ (and preferably a $C_{12}$–$C_{20}$) hydrocarbyl group and $R^3$ is (1) hydrogen or (2) a $$R^4-\underset{\underset{\displaystyle O}{\|}}{C}-$$

group, where $R^4$ is preferably hydrogen or is a $C_1$ to $C_3$ alkyl group or (3) an aliphatic group having 1 to 3 carbon atoms. At least one of $R^3$ is the $R^4C{=}O$ group. It will be understood that "hydrocarbyl" is preferably an aliphatic group, and more preferably the alkyl or the alkenyl group. It may also be an aryl, alkaryl, aralkyl and cycloalkyl group. The aryl portion has from 6 to 14 carbon atoms. The invention also provides the amides per se and a method of using them to reduce fuel consumption in an internal combustion engine.

DESCRIPTION OF SPECIFIC EMBODIMENTS

The diamine amides can be made by any method known to the art. In general, they can be made by reacting an N-alkylalkylenediamine of the formula $$R^2-\overset{\overset{\displaystyle R^3}{|}}{N}-R^1-NH-R^3$$

wherein $R^1$ and $R^2$ are as hereinabove described, and $R^3$ is hydrogen, with an acid of the formula $$R^4COOH$$

wherein $R^4$ is as hereinabove described.

The reaction conditions are not critical. Reaction can take place between the diamine and the acid at a temperature of between about 80° C. and about 250° C., preferably about 120° C. to about 170° C. The reaction will usually be completed in from 3 to 6, but where the reactants demand it, up to 24 hours may be required for reaction completion.

Hydrocarbon solvents, or other inert solvents may be used in the reaction. Included among the useful solvents are benzene, toluene and xylene. In general, any hydrocarbon solvent can be used in which the reactions are soluble and which can, if the products are soluble therein, be easily removed.

In carrying out the reaction, the molar ratio of diamine to acid can range from about 1:0.5 to abot 1:2, but preferably will range from about 1:1 to about 1:2.

Some of the useful amines include tallow-1,3-propylenediamine, oleyl-1,3-propylenediamine, linoleyl-1,3-propylediamine, isostearyl-1,3-propylenediamine, stearyl-1,3-propylenediamine, soya-1,3-propylenediamine, dodecyl-1,3-propylenediamine, hexadecyl-1,3-propylenediamine, heptadecyl-1,3-propylenediamine, coco-1,3-propylenediamine and mixtures of two or more of these.

As the above formula indicates, the acids embraced are formic, acetic, propionic and butyric acids, with formic acid being preferred.

While the reaction outlined is the usual, and preferred one, other reactions may be used to prepare the diamine amids. For example, formate esters can be reacted with the etherdiamines to produce etherdiamine amides as defined above by ammonolysis of such esters. For instance, methyl formate can be reacted with the etherdiamine to form etherdiamine formamides. The reaction is generally exothermic and proceeds at temperatures at from about 50° C. to about 125° C., ratios of reactants, i.e., etherdiamine and formate ester, may be from about 1:0.5 to about 1:2, preferably about 1:1 to about 1:2.

An important feature of the invention is the ability of the additive to improve the resistance to oxidation of oleaginous materials such as lubricating oils, either a mineral oil or a synthetic oil, or mixtures thereof, or a grease in which any of the aforementioned oils are employed as a vehicle. In general, mineral oils, both paraffinic, naphthenic and mixtures thereof, employed as a lubricating oil or as the grease vehicle, may be of any suitable lubricating viscosity range, as for example, from about 45 SSR at 100° F. to about 6000 SSU at 100° F., and preferably from about 50 to about 250 SSR at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the preent invention.

In instances where synthetic oils, or synthetic oils employed as the vehicle for the grease, are desired in preference to mineral oils, or in preference to mixtures or mineral and synthetic oils, various synthetic oils of this type may be successfully utilized. Typical synthetic vehicles include polyisobutylenes, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers typified by a butyl-substituted bis(p-phenoxy phenyl) ether and phenoxy phenylethers.

It is to be understood that the compositions contemplated herein can also contain other materials. For example, other corrosion inhibitors, extreme pressure agents, viscosity index improvers, coantioxidants, antiwear agents and the like can be used. these include, but are not limited to, phenates, sulfonates, succinimides, zinc dialkyl dithiophosphates, and the like. These materials do not detract from the value of the compositions of this invention; rather the materials serve to impart their customary properties to the particular compositions in which they are incorporated.

Mineral oil heat exchange fluids particularly contemplated in accordance with the present invention have the following characteristics: high thermal stability, high initial boiling point, low viscosity, high heat-carrying ability and low corrosion tendency.

Further, the transmission fluids of consequence to the present invention are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2; RR 1005 on "Automatic Transmission Fluid/Power Transmission Fluid Property and Performance Definitions. Specifications for low-temperature and aircraft fluids are defied in U.S. Government Specification MIL-H-5606A.

In addition, the oxidation and corrosion resistance of functional fluids such as hydraulic fluids can be improved by the adducts of the present invention.

The products of this invention can also be employed in liquid hydrocarbon fuels, alcohol fuels or mixtures thereof, including mixtures of hydrocarbons, mixtures of alcohols and mixtures of hydrocarbon and alcohol fuels. About 25 pounds to 500 pounds or preferably about 50 to 100 pounds of the product per thousand barrels of fuel may be used. Liquid hydrocarbon fuels include gasoline, fuel oils and diesel oils. Methyl and ethyl alcohols are examples of alcohol fuels.

In general, the reaction products of the present invention may be employed in any amount which is effective for imparting the desired degree of friction reduction or antioxidant activity. In these applications, the product is effectively employed in amounts from about 0.1% to about 10% by weight, and preferably from about 1% to about 5% of the total weight of the composition.

The following Examples will present illustrations of the invention. They are illustrative only, and are not meant to limit the invention.

EXAMPLE 1

Diamide of N-Tallow-1,3-Propylenediamine

Approximately 160 g of N-tallow-1,3-propylenediamine (commercially obtained as Duomeen T from Armak Chemical Co.) and about 60 g of toluene were charged to a 500 liter stirred reactor equipped with a Dean-Stark condensing trap. Approximately 62 g of 88% formic acid were added with agitation and the mixture was heated for 5 hours up to 160° C. until water evolution ceased. The unreacted starting materials and solvent were removed by vacuum distillation and the product was filtered at about 100° C. through diatomaceous earth to form an amber fluid which became somewhat waxy upon cooling.

EXAMPLE 2

Diamide of N-Oleyl-1,3-Propylenediamine

Approximately 220 g of N-oleyl-1,3-propylenediamine (commercially obtained as Diam 11C from General Mills Inc.) and about 75 g of toluene were charged to a 1 liter reactor equipped as described in Example 1. Approximately 74 g of 88% formic acid were added with agitation and the mixture was heated for 6 hours up to 170° C. until water evolution ceased. The unreacted starting materials and solvent were removed by vacuum distillation and the product was filtered at about 90° C. through diatomaceous earth to form a dark amber fluid upon cooling.

EXAMPLE 3

Amide of N-Coco-1,3-Propylenediamine

Approximately 145 g of N-coco-1,3-propylenediamine (commercially obtained as Duomeen C from Armak Chemical Co.) and about 80 g of toluene were changed to a 1 liter reactor equipped as described in Example 1. Approximately 58 g of 88% formic acid were added with agitation and the mixture was heated for 6 hours up to 145° C. until water evolution ceased. The unreacted starting materials were removed by vacuum distillation and the product was filtered at about 100° C. through diatomaceous earth.

EXAMPLE 4

Monoamide of N-Coco-1,3-Propylenediamine

Approximately 75 g of N-coco-1,3-propylenediamine, 75 g of toluene and 13 g of 88% formic acid were reacted as generally described in Example 3 for a total of 6 hours up to 150° C. The unreacted starting materials were removed by vacuum distillation and the product was filtered at about 100° C. through diatomaceous earth to yield a pale amber liquid.

EXAMPLE 5

Amide of N-Oleyl-1,3-Propylenediamine

Approximately 540 g of N-oleyl-1,3-propylenediamine (obtained commercially as Duomeen D from Armak Chemical Co.), 150 g of toluene and 78 g of 88% formic acid were reacted as generally described in Example 2 for a total of 4 hours up to 160° C. The unreacted starting materials were removed by vacuum distillation and the product was filtered at about 100° C. through diatomaceous earth to yield a pale amber liquid.

The art will understand that the formula for the amide, set forth in the Summary and in the claims, covers all possible amides and mixtures thereof that can be obtained using the reactants disclosed herein. Thus, if 1 mole of diamine and 1 mole of acid are used, one will obtain the monoamide, with any given amide group being on either nitrogen atom. When 1 mole of diamine and 2 moles of acid are used, one gets the diamide, i.e., both nitrogen atoms reacted. If 1 mole of diamine and an amount of acid between 1 and 2 moles is used, a mixture of the possible reactions with the nitrogen site will be obtained, i.e., a mixture of compounds having (1) a monoamide group on one nitrogen site, (2) a monoamide group on the other nitrogen site and (3) a diamide.

EVALUATION OF THE COMPOUNDS

The compounds were evaluated in a Low Velocity Friction Apparatus (LVFA) in a fully formulated mineral or synthetic, automotive engine oil containing an additive package including antioxidant, dispersant and detergent.

Description

The Low Velocity Friction Apparatus (LVFA) is used to measure the coefficient of friction test lubricants under various loads, temperatures, and sliding speeds. The LVFA consists of a flat SEA 1020 steel surface (diameter 1.5 in.) which is attached to a drive shaft and rotated over a stationary, raised, narrow ringed SAE 1020 steel surface (area 0.08 in.$^2$. Both surfaces are submerged in the test lubricant. Firction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the pistor is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cammotor arrangment.

Procedure

The rubbing surfaces and 12–13 ml of test lubricants are placed on the LVFA. A 240 psi load is applied and the sliding speed is maintained at 40 fpm at ambient temperature for a few minutes. A plot for coefficients of friction ($U_k$) vs. speed were taken at 240, 300, 400, and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psi.

TABLE 1

EVALUATION OF FRICTION REDUCING CHARACTERISTICS

| Medium and Additive | % Weight Additive | % Change in Coefficient | |
|---|---|---|---|
| Base Oil A* | — | 0 | 0 |
| Example 1 (1) | 2 | 38 | 35 |
| | 1 | 33 | 44 |
| Example 2 (1) | 2 | 37 | 39 |
| | 1 | 27 | 28 |
| Example 3 (1) | 2 | 22 | 24 |
| Example 4 (1) | 2 | 12 | 15 |
| Base Oil B** | — | 0 | 0 |
| Example 1 (2) | 1 | 34 | 27 |
| | 0.5 | 28 | 18 |
| Example 2 (2) | 1 | 31 | 19 |
| | 1 | 28 | 20 |
| Example 5 (2) | 2 | 35 | 26 |

*Fully formulated SAE 5W/30 synthetic oil.
**Fully formulated SAE 10W/40 100 second paraffinic neutral mineral oil containing other additives as mentioned hereinabove.
(1) In oil A.
(2) In oil B.

The coefficients of friction were significantly reduced relative to the base oil with reductions as high as 44%. It is noteworthy that friction was reduced by up to 44% with the composition containing only 1% of the Example 1 product in test oil A.

Representative samples of the above prepared compositions were also evaluated for antioxidant properties with a catalytic oxidation test. Samples of 200" solvent paraffinic neutral mineral lubricating oil were placed in an oven at 325° F. Present in the samples were the following metals, either known to catalyze organic oxidation or commonly used materials of construction:

a. 15.6 sq. in. of sand-blasted iron wire
b. 0.78 sq. in. of polished copper wire
c. 0.87 sq. in. of polished aluminum wire
d. 0.167 sq. in. of polished lead surface Dry air was passed through the sample at a rate of about 5 liters per hour for 40 hours. Table 2 shows the data.

TABLE 2

CATALYTIC OXIDATION TEST 40 HOURS AT 325° F.

| Medium and Additive | Additive Conc. Wt. % | % Increase in Viscosity of Oxidized Oil Using KV 100° | Neut. No., NN |
|---|---|---|---|
| Base Oil B | — | 67 | 3.62 |
| Example 1 | 0.5 | 24 | 4.72 |
| | 1.0 | 6 | 1.32 |
| Example 2 | 0.5 | 22 | 2.97 |
| | 1.0 | 9 | 1.44 |
| Example 3 | 1.0 | 21 | 3.45 |
| Example 4 | 1.0 | 11 | 0.98 |

The results clearly show the stability exhibited by these multipurpose friction reducers under severe oxidizing conditions at elevated temperatures.

These diamine reaction products were non-corrosive to copper as measured in 200" solvent paraffinic neutral lubricating oil using the ASTM D130-80 Copper Strip Corrosivity Test. This is shown in Table 3.

TABLE 3

COPPER STRIP CORROSIVITY

| Medium and Additive | Additive Conc. Wt. % | Test Rating ASDTM D130-80 3 Hrs. @ 250° F. | Test Rating ASTM D130-80 6 Hrs. @ 210° F. |
|---|---|---|---|
| Example 1 | 0.5 | 1B | 1B |
| | 1.0 | 1A | 1A |
| Example 2 | 0.5 | 1B | 1A |
| | 1.0 | 1A | 1A |
| Example 3 | 1.0 | 1A | 1A |
| Example 4 | 1.0 | 1A | 1A |
| Example 5 | 1.0 | 1A | — |

It is apparent from the above data that the products of this invention are effective in a variety of uses. That is, they reduce friction and thereby help to decrease fuel consumption, they are extremely effective antioxidants and they do not significantly corrode copper.

In using the lubricant and fuel compositions of this invention to reduce fuel consumption in an internal combustion engine, it will be understood that the compositions can be used in any combination. That is the fuel can be used alone, the lubricant can be used alone or the two can be used together.

Comparison of Products of This Invention With Prior Art Products

As mentioned above, U.S. Pat. No. 3,778,372 discloses related additive compounds which are the reaction products of formic acid with amines of the structural formula

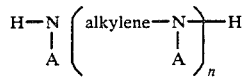

where n is an integer preferably less than about 10, e.g., 2 to 6, A is hydrogen or a substantially hydrocarbon radical. It follows then that some of the amide formed with formic acid will have structures

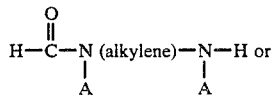

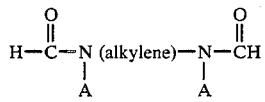

where n is 1.

In contrast, applicant's amides have the structure

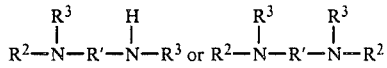

where R' is a $C_2$ to $C_4$ alkylene group, $R^2$ is a $C_{12}$ to $C_{30}$ (preferably $C_{12}$–$C_{20}$) group and $R^3$ is (1) hydrogen or (2) a

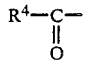

group where $R^4$ is hydrogen or $C_1$ to $C_3$ alkyl groups. In U.S. Pat. No. 3,778,372 the end Nitrogen atoms must always be substituted with at least one foramyl substituent, (number of carbon atoms=1). In the composition of the instant invention at least one of the nitrogen atoms is substituted with an alkylene group between 12 and 30 carbon atoms.

To demonstrate the difference in lubricity, samples of the formic acid-tetraethylene pentamine product and formic acid-polyethylene polyamine composition of Examples 2 and 4 respectively of U.S. Pat. No. 3,778,372 were prepared.

These samples were tested in tests made wit the LVFA equipment described above in comparison with the composition of Example 1 above in the instant disclosure.

Results of the tests ae tabulated in Table 4 below:

TABLE 4

| Medium and Additive | % wt. Additive | % Charge in Coefficient of Friction 5 ft/min | % Charge in Coefficient of Friction 30 ft/min |
|---|---|---|---|
| Base Oil A | — | 0 | 0 |
| Base Oil A plus product from USP '372, Ex. 2 | 1% | −12* | −13* |
| Base Oil A plus product from USP '372, Ex. 4 | 1% | 0 | 0 |
| Example 1 Product In Base Oil A | 1% | 33 | 44 |
| Example 1 Product in Base Oil A | 2% | 38 | 35 |

*Denotes a 12% and 13% increase in coêfficient of friction at 5 and 30 ft/min, respectively.

The U.S. Pat. No. 3,778,372 compounds have the formula:

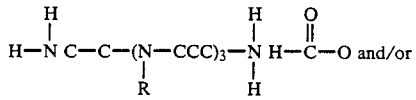

and/or

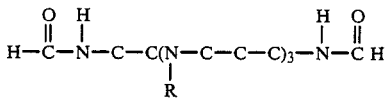

Applicant's compound:

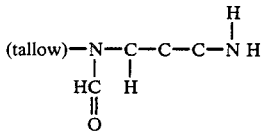

in which the "A" of U.S. Pat. No. 3,778,372 corresponds to the tallow substituent will always have a carbon number greater than that of preferably less than about 10 taught in U.S. Pat. No. 3,778,372.

I claim:

1. A liquid fuel composition comprising a major proportion of a liquid fuel, and a friction reducing or antioxidant amount of a product of the formula

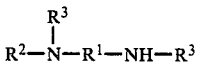

wherein $R^1$ is a $C_2$ to $C_4$ alkylene group, $R^2$ must be a $C_{12}$ to $C_{30}$ hydrocarbyl group and $R^3$ is (1) hydrogen, (2) a

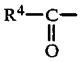

group wherein $R^4$ is hyrogen or a $C_1$ to $C_3$ alkyl group or (3) a $C_1$ to $C_3$ aliphatic group, at least one of the $R^3$ groups being selected from (2).

2. The composition of claim 1 wherein $R^2$ is an alkyl, alkenyl, aryl, aralkyl, alkaryl or cycloalkyl group.

3. The composition of claim 1 wherein $R^2$ and $R^3$ are alkyl groups.

4. The composition of claim 1 wherein $R^2$ and $R^3$ are alkenyl groups.

5. The composition of claim 1 wherein at least one $R^3$ is the $R^4C{=}O$ group.

6. The composition of claim 5 wherein $R^4$is hydrogen.

7. The composition of claim 1 wherein $R^2$ is a dodecyl, oleyl, tallow, coco, isostearyl, stearyl, linoleyl, soya, hexadecyl or heptadecyl group or mixtures of such groups.

8. The composition of claim 1 wherein the product has the formula

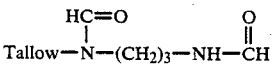

9. The composition of claim 1 wherein the product has the formula

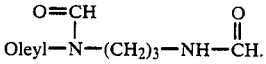

10. The composition of claim 1 wherein the product has the formula

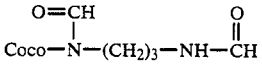

11. The composition of claim 1 wherein the product has the formula

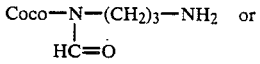

or

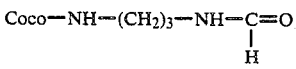

12. The composition of claim 1 wherein said fuel is a liquid hydrocarbon of alcohol fuel.

13. A method for reducing fuel consumption in an internal combustion engine which comprises fueling said engine with a liquid fuel composition containing per 1000 barrels of fuel between about 25 and about 500 pounds of a product of the formula

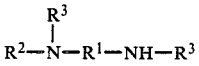

wherein $R^1$ is a $C_2$ to $C_4$ alkylene group, $R^2$ must be a $C_{12}$ to $C_{30}$ hydrocarbyl group and $R^3$ is (1) hydrogen, (2) a

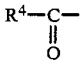

group wherein $R^4$ is hydrogen or a $C_1$ to $C_3$ alkyl group or (3) a $C_1$ to $C_3$ aliphatic group, at least one of the $R^3$ groups being selected from (2).

14. A liquid fuel composition comprising a major portion of a liquid fuel and a friction reducing or antioxidant amount of a mixture of compounds of the formulas:

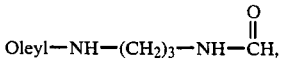

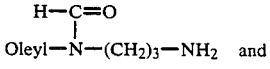

and

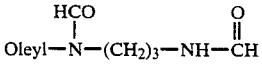

15. A liquid fuel composition comprising a major portion of a liquid fuel and a friction reducing or antioxidant amount of a mixture of compounds of the formulas:

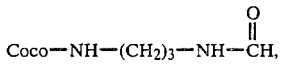
-continued
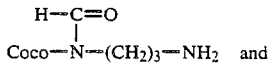
and
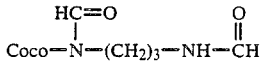
* * * * *